United States Patent [19]

Sias et al.

[11] Patent Number: 4,673,605

[45] Date of Patent: Jun. 16, 1987

[54] BODY SUPPORT PAD

[75] Inventors: Ralph M. Sias; Nancy J. Hurley, both of North Hollywood, Calif.; Melvin W. Dalebout, Salt Lake City, Utah

[73] Assignee: Baxter Travenol Laboratories, Inc., Deerfield, Ill.

[21] Appl. No.: 890,429

[22] Filed: Jul. 25, 1986

Related U.S. Application Data

[63] Continuation of Ser. No. 737,373, May 23, 1985, Pat. No. 4,605,582.

[51] Int. Cl.[4] ..... A61G 7/02; A47C 27/22

[52] U.S. Cl. ..... 428/120; 428/178; 428/179; 428/131; 5/60; 5/431; 5/446; 5/461; 5/464

[58] Field of Search ..... 5/431, 432, 417, 481, 5/448, 461, 464, 449, 446, 60; 119/28; 428/120, 131, 132, 178, 179, 174, 44; 404/36, 42; 267/145; 297/DIG. 1; 52/180

[56] References Cited

U.S. PATENT DOCUMENTS

| | | | |
|---|---|---|---|
| 3,231,454 | 1/1966 | Williams | 428/132 |
| 3,258,791 | 7/1966 | Kaplan | 5/481 |
| 3,605,145 | 9/1971 | Graebe | 5/455 |
| 3,741,411 | 6/1973 | Peacock | 428/178 |
| 3,828,376 | 8/1974 | Flam | 5/481 |
| 3,843,980 | 10/1974 | Rodriguez | 5/431 |
| 3,940,811 | 3/1976 | Tomikawa et al. | 5/481 |
| 3,955,019 | 5/1976 | Keith | 428/35 |
| 4,070,719 | 1/1978 | Morgan | 5/481 |
| 4,383,342 | 5/1983 | Forster | 5/417 |

*Primary Examiner*—Alexander S. Thomas

*Attorney, Agent, or Firm*—Roger A. Williams; Paul C. Flattery

[57] ABSTRACT

A body support pad for inhibiting the occurrence of decubitus ulcers. The body support pad includes a generally planar but flexible base member having an upper surface and a lower surface. A plurality of pillars are arrayed across the lower surface and extend outwardly therefrom. The pillars can be arranged in discrete arrays wherein the pillars in each array can have specific pressure dipersing characteristics. The body support pad also includes a plurality of pods extending outwardly from the upper surface of the base member. The pods can be arranged in discrete arrays wherein the pods in each array can have specific pressure dispersing characteristics. The body support pad also includes ventilation apertures for permitting free flow of air in and around the pad.

28 Claims, 9 Drawing Figures

BODY SUPPORT PAD

This application is a continuation of application Ser. No. 737,373, filed May 23, 1985, now U.S. Pat. No. 4,605,582.

BACKGROUND OF THE INVENTION

A frequent malady of nonambulatory people such as people confined to beds or wheelchairs is that of the occurrence of decubitus ulcers, frequently referred to as pressure sores or bed sores. A major cause of the disorder is that conventional bedding and wheelchairs provide little in the way of either body support or reduced seating pressure. As there is little support or reduced pressure, the patient's weight exerted essentially constantly on tissue surrounding the skeletal structure can give rise to the formation of decubitus ulcers.

There are generally two types of patient support structures currently available. These structures can be classed as either dynamic or static. Dynamic pads or cushions are those which involve outside power sources to perform their function. Although such systems are convenient for bed confined patients, they are undesirable for wheelchair use due to their lack of mobility. In addition, such dynamic cuhsions are undesirable as they are relatively expensive.

Static cushions are generally preferred due to their being less expensive and their ability to provide mobility such as for use in wheelchairs. The static cushions can be classed into two categories: (1) bladder type cushions and (2) foam cushions.

Bladder type cushions are basically flexible walled bags such as plastic bags which are filled with a fluid or some form of gel. The fluid can be air or water. The gel filled bladders are filled with some type of gel material such as ethylene glycol, polyethylene glycol, silicone, and the like. Bladder type cushions are shown in U.S. Pat. No. 2,434,641 of Burns; and U.S. Pat. Nos. 3,605,145; 3,870,450; and 4,005,236, all of Graebe.

The foam cushions can be any structure using a piece of foam. For example, foam cushions can be solid pieces of foam or some type of foam laminate structure. Examples of foam type cushions are the "egg crate" cushion and the contoured foam cushions. One cushion is disclosed in U.S. Pat. No. 3,231,454 of Williams.

Foam cushions are generally the least expensive type of cushion. The foam cushions are undesirable in that they have a tendency to build up significant amounts of heat. A drawback with the build up of heat is that it is believed that heat buildup is a contributing factor to the occurrence of decubitus ulcers. The bladder products tend to be more expensive and tend to perform better in terms of pressure distribution. Some of the bladder products are low in weight like their counterparts in the foam cushion areas. Bladder products, like the foam cushions, also tend to cause tremendous heat buildup. Another drawback with bladder products is that they tend to elevate the patient to a height greater than foam cushions.

It would be desirable to provide a lightweight, low cost, body support pad which would have the beneficial pressure distribution characteristics of the bladder products as well as the beneficial properties of the foam cushions.

SUMMARY OF THE INVENTION

The invention herein is directed to a body support pad which is relatively inexpensive, easy to manufacture, easy to clean, and which provides distribution of the pressure exerted on the pad so as to inhibit the formation of decubitus ulcers. More particularly, the body support pad herein is suited for use on wheelchairs for inhibiting the occurrence of decubitus ulcers on the patient confined to the wheelchair.

The pad herein is a body support pad which includes a flexible, generally planar base member which has an upper surface and a lower surface. The body support pad is one integral structure which can be made by molding the pad from a moldable material such as a microcellular urethane. The pad includes a flexible, generally planar base member having an upper surface and a lower surface. Positioned along the lower surface is a plurality of pillars which extend outwardly from the lower surface. The plurality of pillars is arranged in discrete arrays of individual pillars of similar pressure dispersion characteristics. That is, the pillars in any one particular array have the same pressure dispersing characteristics, which pressure dispersing characteristics can differ from the pillars in an adjacent or different array. The pillars are provided such that they substantially evenly contact any supportive surface on which the pad is place when a body is supported on the pad. That is, the force of a person positioned on the pad displaces the flexible, planar base and the pillars generally all contact the supportive surface and begin to deflect themselves to provide a generally even distribution of the pressure across the entire plurality of pillars.

A plurality of hollow pods extend outwardly from the upper surface of the flexible, generally planar base. The pods are generally conical with generally hemsipherically shaped upper portions. The pods are adapted to provide as great a surface area as possible for contacting a body supported on the pad in order to displace or disperse the force of the body on the pad over the greatest surface area. The pods can be slit so that when the pods collapse upon exertion of a force thereupon, a greater surface area remains in contact with the body compressing the pods. The pods are arranged in discrete arrays across the upper surface of the pad base member. The pods in each array have a pressure dispersing characteristic which is uniform within the array but which differs from the pressure dispersing characteristics of the pods in any other array. The pods in a particular array provide a resistive force to the body being supported on the pad and the pods are designed to provide such a resistive force generally normal to the body. By each of the pods providing a resistive force essentially normal to the body supported on the pad, there is generally an even distribution of the seating pressures across the surface area of the portion of the body contacting the pad.

With regard to the pillars, the pillars are hollow and arranged in any sufficient number of arrays corresponding to the differing number of force location points of the patient's body when positioned on a supporting surface. For a seating pad, it has been found that five arrays provide the optimum beneficial properties of pressure distribution. That is, five differing type of pillars with five unique pressure dispersing characteristics are arrayed across the lower surface of the base member of the pad. The pressure dispersing characteristics of the pillars can be attenuated by changing the height and wall thickness of each individual pillar. The pods are generally conical shaped with a generally rounded or hemispereically shaped apex.

Similarly to the pillars, the pods are arrayed in a sufficient number of arrays to provide the beneficial properties and pressure dispersing characteristics based upon the body and how it is supported. For a seating pad, it has been found that two types of pods provide sufficient beneficial properties. These two types of pods are arrayed across the upper surface of the planar base member of the pad. The pressure dispersing characteristics of each pod can be attenuated by modifying the wall thickness of each pod. The pods are generally cylindrical or frustoconical in shape with a hemispherically shaped upper surface. Both the wall thickness of the cylindrical portion and the wall thickness of the hemispherically shaped portion can be modified to adjust the pressure dispersing characteristics of each pod.

The pad herein is also provided with ventilation apertures which extend through the base member and, more particularly, which extend through the end walls of the respective pillars and pods. It is desirable to provide the ventilation apertures to permit the free flow of air which aids in the reduction of heat buildup.

The body support pad herein can be easily molded of a lightweight material in a single molding step. The pad can be molded of an integral material as the pods and pillars are offset from one another. The pad herein can be constructed of a durable material which can be resistant to fecal and urinary contamination or other body fluids. The pad herein also provides a structure which can be further modified by an attendant or by the user to accommodate particular features of a patient. That is, the various pillars and pods (and particularly the pillars) can be modified by an attendant such as by contouring to fit the needs of a particular patient.

The body support pad herein can be part of a combined body support cushion. That is, a body support cushion can include the above-described body support pad and a foam pad overlay which rests on top of the pods of the body support pad. The foam overlay is a lightweight foam material which is an open cellular foam to provide additional ventilation to the patient. In addition, the foam pad can be further ventilated by providing ventilation apertures extending through the foam overlay. The foam overlay aids in increasing the surface area of the patient which contacts the pods and aids in increasing comfort to the person.

Extending over the overlay is a cushion cover. A cushion cover is selected which has a wickability to transport moisture away from the body. It is also desirable to provide a cover which is knitted to have a two-way stretch to prevent hammocking. Hammocking is undesirable as it causes undue pressure forces on the body. It is also desirable to provide a cushion cover which is an open knit so as to enhance breathability of the material and air flow through the entire cushion structure.

BRIEF DESCRIPTION OF THE DRAWINGS

The accompanying drawings illustrate the best mode presently contemplated for constructing a patient support pad for use when a patient is seated. The invention will be better understood by referring the appended drawings wherein.

DETAILED DESCRIPTION

The body support pad that is the subject of the invention herein will be described with regard to the accompanying drawings. In particular, the body support pad will be described with regard to a body support pad 10 shown in FIG. 1 designed for use as a seating pad. That is the body support pad 10 shown in FIG. 1 can be used as a seating pad for use in wheelchairs or on chairs and the like. It should be recognized that the description herein with regard to the seating pad can be applicable to a pad which can be used for a reclining person such as a mattress pad and the like. For ease of description, the body support pad that is the subject of the invention herein will be described with regard to a seating pad as shown in the accompanying drawings.

Figure 1:
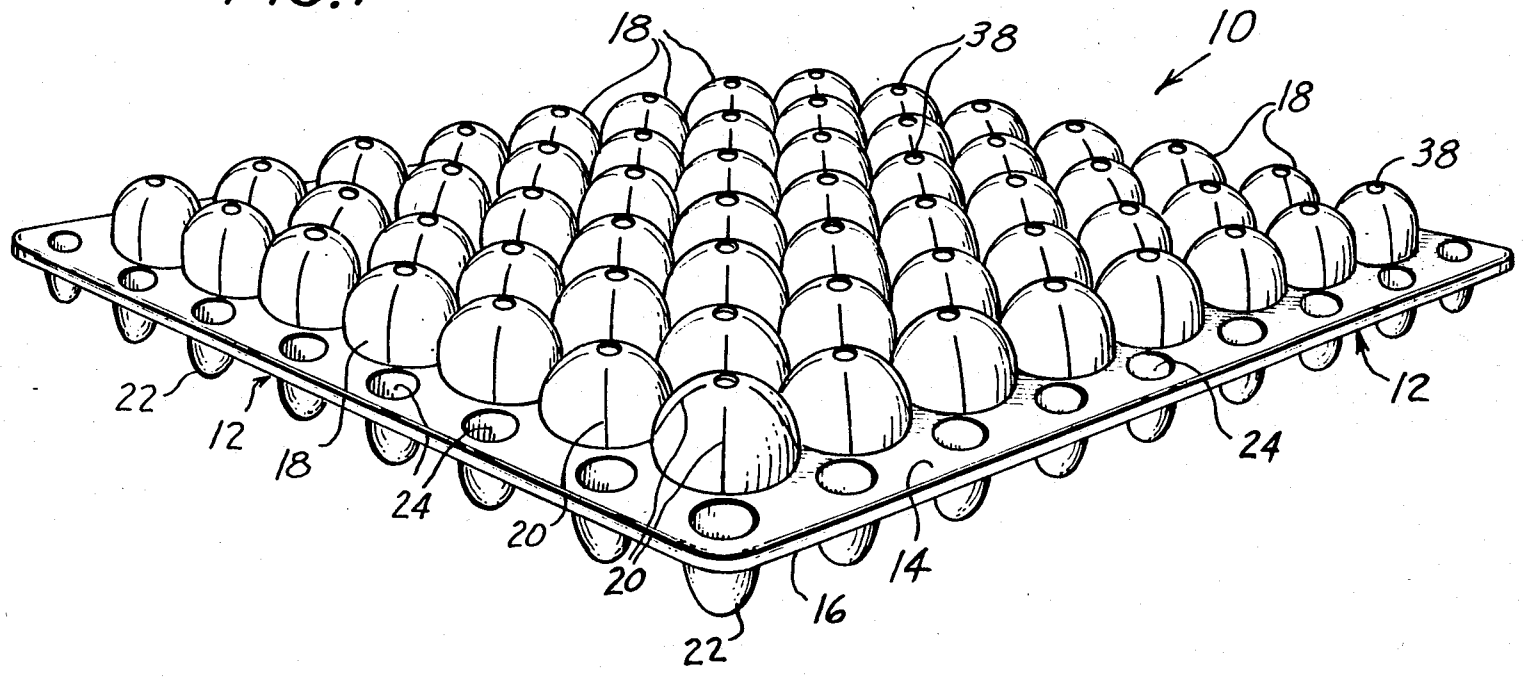
FIG. 1 is a perspective view of the body support pad herein.

In FIG. 1, a body support pad is constructed of an integrally molded microcellular urethane elastomer having a durometer of about 20 to 40 on the Shore A scale. The body support pad is molded from a urethane microcellular urethane elastomer having a density in its molded form of about 0.40. Other moldable materials can be used for constructing the body support pad but it has been found that a microcellular urethane elastomer is the preferred material as it provides a pad which is light in weight, provides good distribution of seating pressures, can be easily ventilated, is durable, and generally resistant to body fluids.

The body support pad 10 includes a generally flexible base member 12 which extends generally in a plane and which has an upper surface 14 and a lower surface 16. Extending upwardly from the upper surface 14 is a plurality of pods 18. The pods are generally cylindrical in shape with an upper hemisperical surface. The pods 18 also include slits 20 along their sides so that the pods will compress in a substantially uniform manner upon a force being exerted upon them. The pods are integrally molded with the base member 12 and are generally hollow structures which are open on the lower surface 16 of the base member as can be more readily seen with regard to FIG. 6. With regard to FIG. 6, the pod cavity 25 can be seen which opens into the pods.

Figure 4:
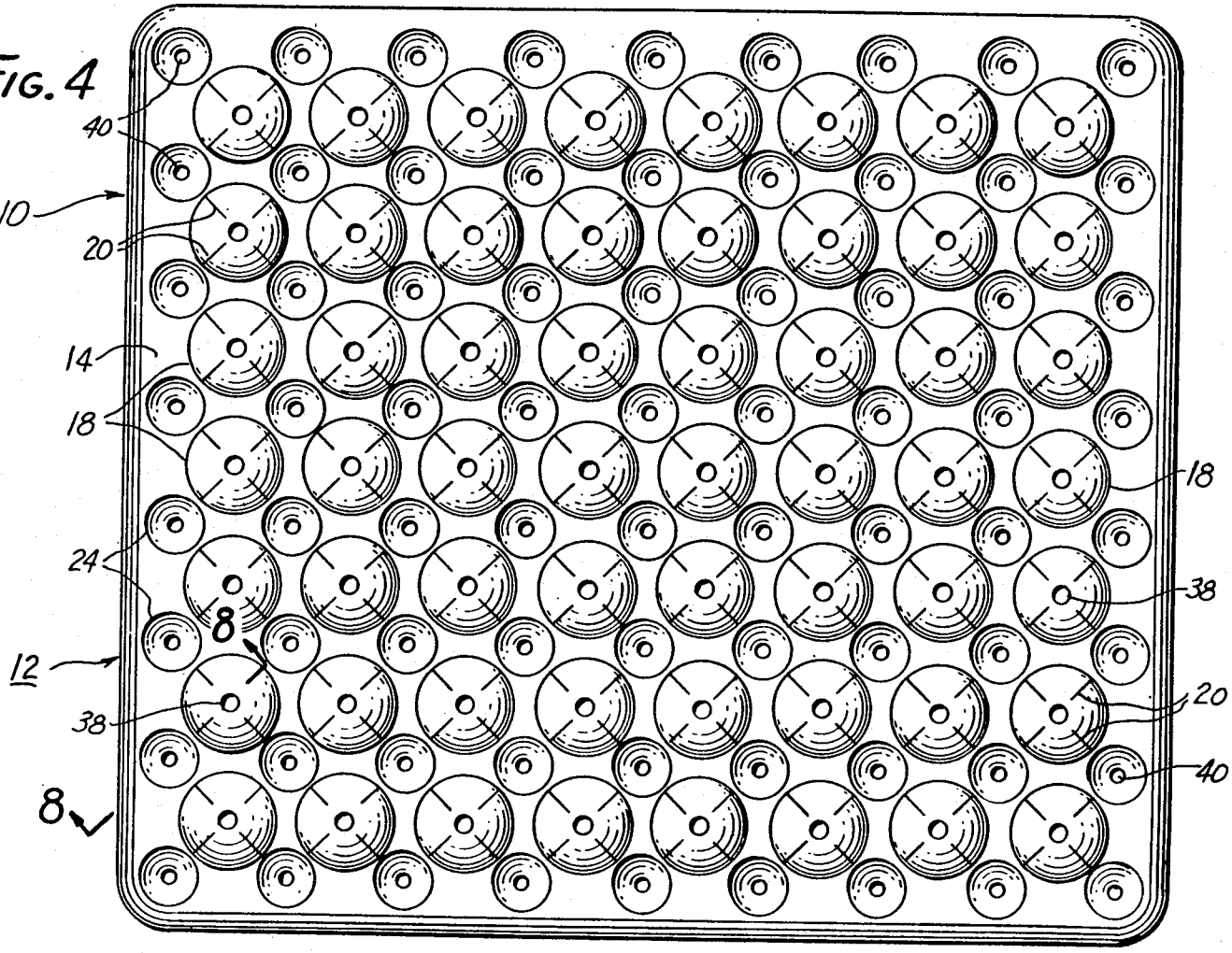
FIG. 4 is a top plan view of the body support pad of FIG. 1.

Extending outwardly from the lower surface 16 of the base member are a plurality of pillars 22. The pillars 22 provide contact with a supporting surface upon which the body support pad 10 is placed while the pods 18 provide contact with a body which rests or is supported by the body support pad 10. The pillars 22 are also integrally molded from the material that constitutes the base member. The pillars are also hollow structures which are open on the upper surface 14 of the base member through the pillar cavities 24 as can be seen in FIGS. 1 and 4. Also seen in the figures, the pillars and pods are offset from one another so that they can be readily molded and, as will be hereinafter discussed, to provide an acceptable pressure dispersion across the pad assembly.

In the embodiment shown in FIG. 1, there are 56 pods arrayed over the upper surface of the base member. There are 72 pillars arrayed over the lower surface of the base member. The number of pods and pillars can be varied, depending upon the use of the pad. It has been found herein that in order to provide the greatest surface area to support a body in a seating position, that 56 pods are preferred and 72 pillars are preferred for a body support pad being about 15 and $\frac{3}{4}$ inches wide by about 17 and $\frac{3}{4}$ inches deep and 2 and $\frac{5}{8}$ inches in height. The base diameter for the pods being about 1 and $\frac{3}{4}$ inches and their height about 1 and $\frac{1}{8}$ inch with four slits 20 extending about one to one and one-eighth inches ($1-1\frac{1}{8}''$) in length. The pillars have an opening radius of about 1 and $\frac{1}{8}$ inches and range in a height from about $\frac{3}{4}$ inch to 1 and $\frac{1}{4}$ inch. The base member has a thickness of about $\frac{1}{4}$ inch. The particular configurations for the pods and pillars and their individual pressure dispersing characteristics will be hereinafter detailed.

Figure 2:
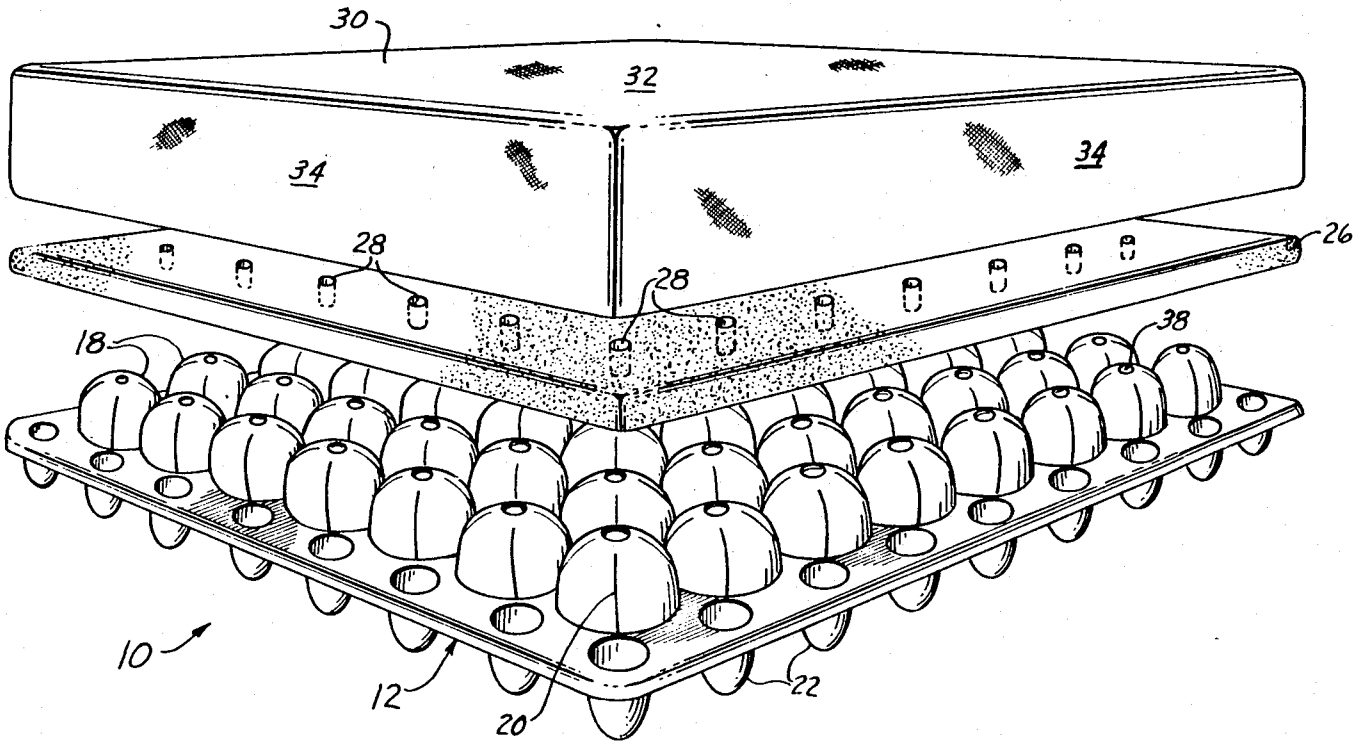
FIG. 2 is a perspective exploded view of a patient support cushion utilizing the body support pad of FIG. 1.

With regard to FIG. 2, a body support cushion is illustrated in an exploded view. In FIG. 2, the body support pad 10 provides the basic pressure dispersing portion of the overall cushion assembly. Layered on the surface provided by the tops of the plurality of pods 18 is a foam overlay 26. The foam overlay is a foam pad which is about 1.8 pounds in density with a 30 indentation load deflection (ILD). The foam overlay has a high resiliency and can be constructed of any suitable foaming material such as urethane, which is preferred. It is also preferred to have a foam material which is fire retardant in order to comply with most applicable fire regulations and codes. It is preferred to use an open celled foam structure in order to provide adequate ventilation for the body resting upon the cushion. However, a closed cell foam can be used in situations wherein a slow memory for the foam overlay is desired. It has been herein that additional ventilation is preferred and such additional ventilation can be provided by placing ventilation apertures 28 through the foam overlay. By providing the ventilation apertures with a sufficient diameter, such as about 3/16 inch in diameter, the apertures remain open, even under loading so as to maintain adequate ventilation. In the preferred embodiment for a foam overlay, it was found that about 42 ventilation apertures could be provided, each with a diameter of about $\frac{5}{8}$ to 3/16 inch. The foam overlay provides an ability to increase the surface area which is in contact with the body and as the surface area is increased over that which could be provided by the individual pods, there is increased comfort to the body.

The body support cushion also includes a fabric cover 30 which extends over and around both the foam overlay 26 and the body support pad 10. The cover 30 provides a means for maintaining the foam overlay on the body support pad. The cover provides an upper surface 32 and a sidewall 34 which wraps and extends around the foam overlay and body support pad. It has been found that the cover should be selected from a material which provides wickability, the ability to transport moisture away from the body supported by the pad. It is also desirable to provide a cover which will prevent or at least reduce what is commonly referred to as the hammocking effect. The hammocking effect is created by nonstretchable fabrics when a force or load is exerted upon them. Hammocking causes undue forces to be exerted upon a body. A preferred material has been found to be a 100% polypropylene which is readily wickable and which is a knitted fabric having a two-way stretch to reduce hammocking. It is also preferred to use an open knit to make the cover as an open knit increases breathability through the material of the cover and, therefore, increases air flow through the cushion assembly. The increased air flow or ventilation of the cushion assembly greatly aids in reducing or inhibiting the occurrence of decubitus ulcers. It is also desirable to provide a cover which will prevent or retard fires should the cover come into contact with a flame or embers such as can occur with fallen cigarettes.

Figure 3:
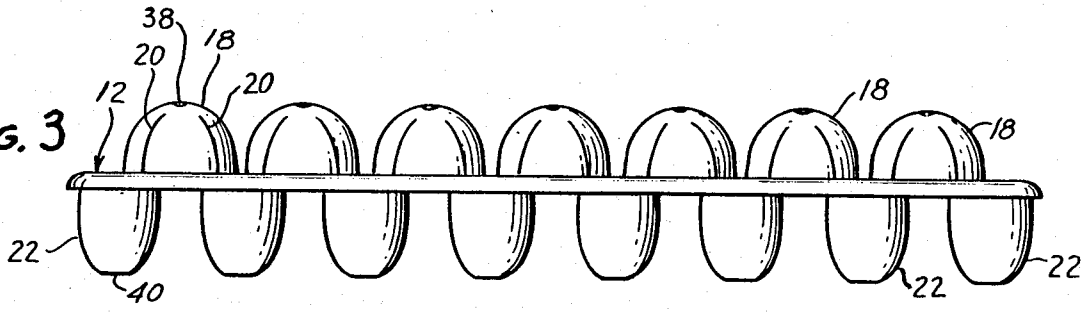
FIG. 3 is a side elevational view of the body support pad of FIG. 1.

In FIG. 3, a side elevational view of the body support pad is illustrated. As can be seen in the side elevational view, the pods 18 are offset from the pillars 22. It has been found herein that by offsetting the pods from the pillars, a beneficial pressure distribution can be created. The side elevational view of FIG. 3 also shows the slits 20 on the pods 18. The slits 20 are placed about 90° apart on each pod, thus providing four slits for each pod. The slits provide a uniform deflection of each pod upon a force being exerted thereupon. The slits also provide an ability for the surface of the pod to maintain a relatively large surface area upon collapse which remains in contact with the body exerting the force and causing the collapse of each pod. That is, the square, cross-shaped surface of each pod which is formed upon collapse provides a greater surface area than a circular cross section of a pod if the pod were not slotted. FIG. 3 also shows the ability of a pad herein to be ventilated by the appropriate ventilating apertures provided on the pad. As can be seen, the pods can include a pod ventilation aperture 38 at or along their upper curved surfaces and the pillars can be provided with a corresponding pillar ventilating aperture 40 on their curved surfaces. For increased ventilation, ventilation apertures which extend through the base member between the pods and pillars can be provided. The benefit of providing a wide variety of ventilation prevents undue heat buildup which has been found to be a contributory cause to the formation of decubitus ulcers.

Although the body support pad with the described offset pods and pillars being constructed of a flexible and open celled microcellular material, such as urethane, is believed to be unique, the particular arrangement of the pods and the pillars in the design of the pad provide additional beneficial properties for inhibiting the occurrence of decubitus ulcers. Now with reference to FIGS. 4 and 5, the pod structure and placement will be described. FIG. 4 is a top plan view of the body support pad 10 showing the pods arrayed across the upper surface in an array that is $8\times7$ pods for a total of 56 pods. That is, the pods are arranged in 8 columns of 7 rows each. Within this main array of the pods, there are two discrete arrays of pods in which the pods have specific pressure dispersing characteristics with each of the two arrays having pods of differing pressure dispersing characteristics. All of the pods, however, have the four provided slits 20 regardless of their pressure dispersing characteristics.

Figure 8:
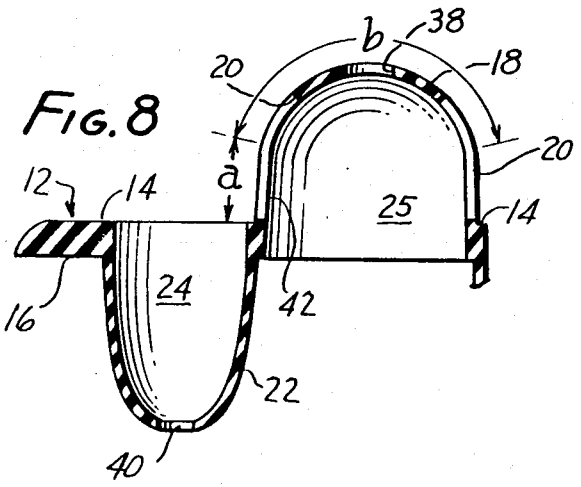
FIG. 8 is a cross-sectional view of the body support pad taken along lines 8—8 of FIG. 4.
Figure 5:
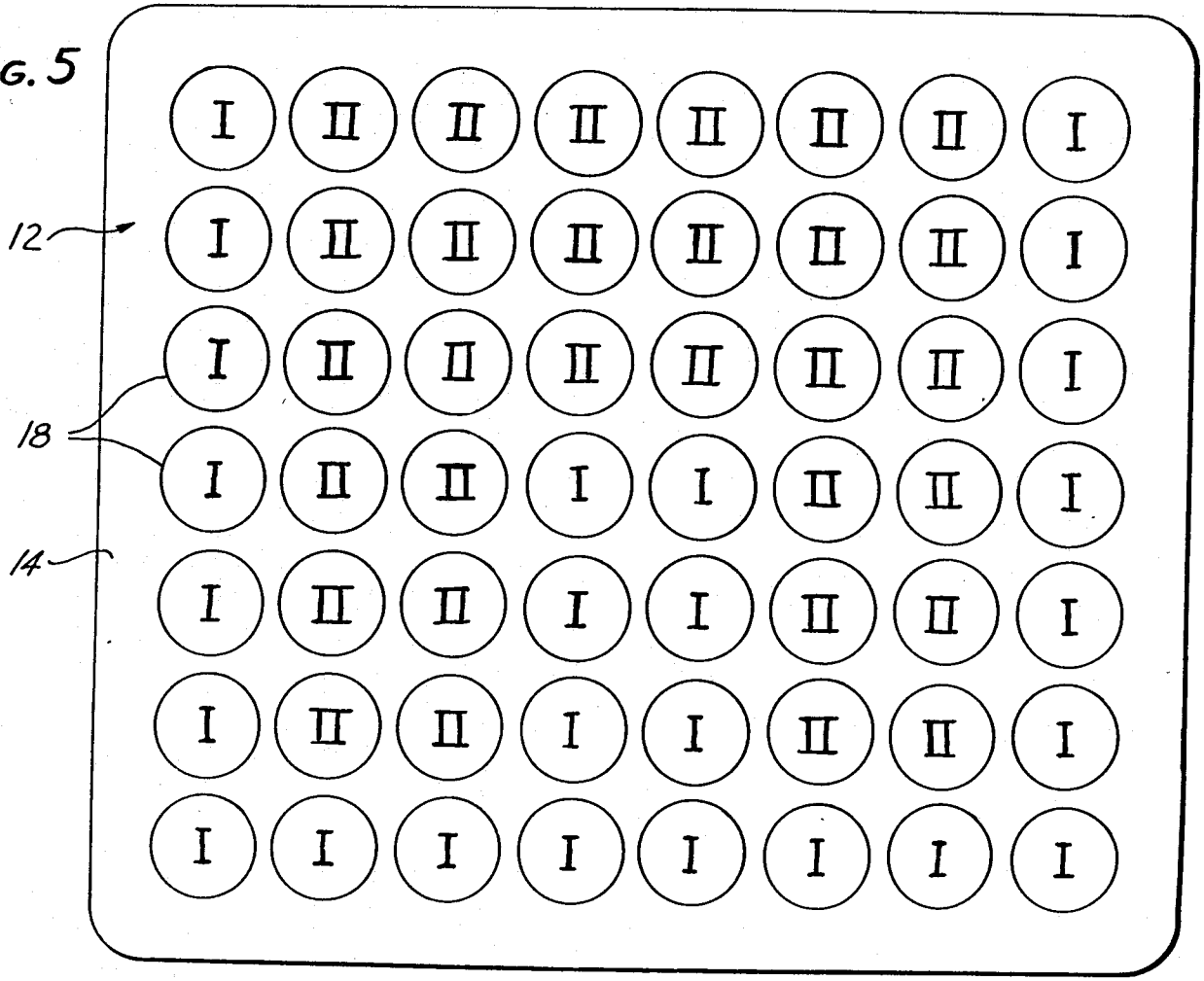
FIG. 5 is a diagramatic representation of the pod layout of the body support pad.

The arrangement of the two arrays of pods of differing pessure dispersing characteristics is illustrated in FIG. 5. FIG. 5 represents a preferred arrangement of the pods for a wheelchair pad wherein the body support pad is constructed of a molded, microcellular, urethane foam. With regard to FIG. 5, the back of the body support pad is at the top of the Figure. It has been found that two different arrays are sufficient to provide beneficial properties although more than two arrays can be utilized. With regard to FIG. 5, a first array of pods extends generally along the three sides of the body support pad and about half-way up the center of the pad. The first array of pods is identified by the Roman Numeral I in the center of the schematically illustrated circles which are representative of the pods. The remaining pods identified by the Roman Numeral II constitute the second array of pods. The second array of pods is arrayed to represent the area of the body support pad which encounters the greatest force when supporting a body. The pods in the second array are less resistive and tend to disperse the forces to a greater extent throughout the pad than the pods in the first array. The pressure dispersing characteristics of the pods are controlled by the durometer of the material making up the pad, as well as by the wall thickness of the pods, both in the curve portion and the straight portion. This difference in sidewall thickness is illustrated in FIG. 8 which is a cross section of the body support pad. As can be seen in FIG. 8, each pod 18 has a pod sidewall 42 having a generally straight wall section designated as Section "a" and a curved wall section designated as Section "b." By modifying the thickness of each of the sidewall sections, the pressure dispersing characteristics of a pod can be varied. For example, in the preferred embodiment, the pods in the first arry I have a wall thickness in the curved wall section "b" of about 0.10 inch, and have a wall thickness in the straight wall section "a" of about 0.112 inch. The pods in the second array II which has a less pressure resistive characteristic have a wall thickness of about 0.10 inch in both the curved and straight wall sections.

These dimensions are further defined in the preferred embodiment by the pods measuring 1 and $\frac{3}{4}$ inches in diameter and having a height of about 1 and $\frac{1}{8}$ inch with four slits each being about 1 and $\frac{1}{8}$ inch in length.

The basic shape and structure of the pods has been selected in order to provide the maximum surface area while providing beneficial pressure dispersing characteristics. The shapes were selected based upon force/compression analysis performed on differing shaped structures utilizing different shapes, sizes, and thicknesses for pods. The preferred embodiment of the pod configuration was based on the ability to provide maximum surface area at minimum deflection, to provide consistant load resistance at the widest range of compression forces, and to provide for a compression force that is both horizontal and diagonal as is the force from a patient's buttocks resting upon the pad. The selected dimensions and shape for the pods provides a resistive force on the body supported by the pad.

Figure 6:
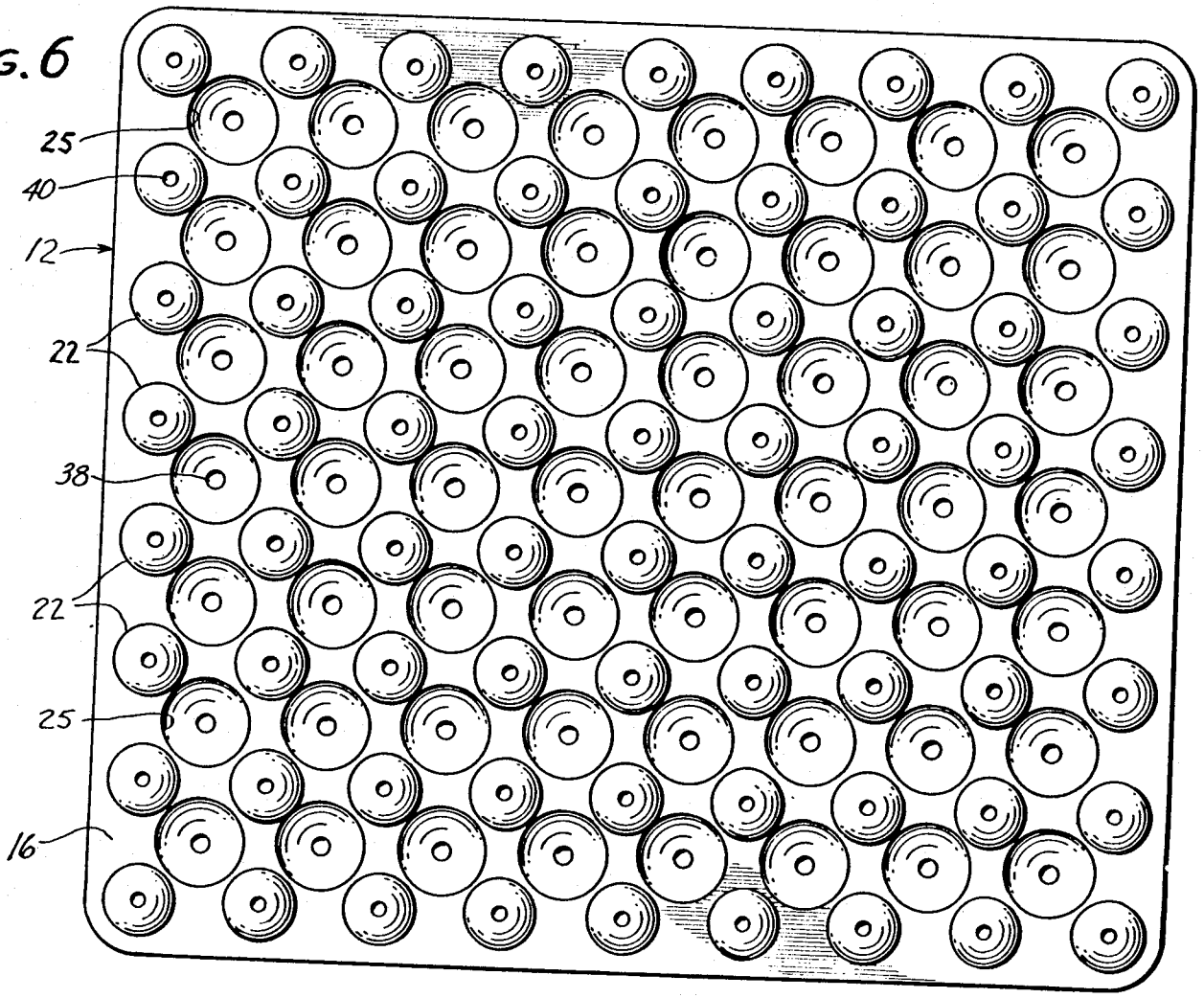
FIG. 6 is a bottom plan view of the body support pad of FIG. 1.

The pillar arrangement for the body support pad is illustrated in the bottom plan view illustrated in FIG. 6. As can be seen in FIG. 6, the pillars 22 are arranged in an array of nine columns of eight rows each, for a total of 72 pillars for the wheelchair pad. The view shown in FIG. 6 also shows the pod cavities 25 which illustrate the open, hollow structure of the pods. The pillars are arranged in discrete arrays across the lower surface of the base member of the body support pad. The arrangement of the arrays is shown by the schematic representation of the pillars by the circles in FIG. 7. With regard to FIG. 7, the back of the pad is also indicated as being at the top of the figure illustrated. The pillars are arranged in a plurality of arrays. In the preferred embodiment shown, the pillars are arranged in five distinct arrays of pillars across the lower surface. The pillars are provided in a height range from about $\frac{3}{4}$ inch to about 1 and $\frac{1}{4}$ inch and are provided with a wall thickness of from about 0.10 inch to about 0.175 inch. By selecting pillars within these ranges, varying pressure dispersing characteristics can be imparted to the individual pillars in a given array.

The height of the pillars is selected based upon the expected load or pressure to be exerted in any of the discrete areas of the pad. The body support pad is constructed of a flexible material and the generally planar base member 12 will distort downwardly when a pressure is exerted on the upper surface. This downward distortion can be predicted by knowing how the body will be positioned on the upper surface. That is, there will be some areas of greater distortion than others. For this reason, the pillars are arranged in discrete arrays of individual pillars exhibiting certain pressure dispersing characteristics. In those areas where it is predicted that the base member will distort greatest, the pillar height is shortened and it is at its lowest height. In the areas where there will be little distortion, the pillars will have their greatest height. In the areas between such two extremes, there can be a variation in height, depending upon the expected load and deflection of the base member. The pillars are all adjusted in height such that when a load is placed upon the upper surface of the pad, all of the pillars will be in contact with the supporting surface upon which the body support pad rests. In this manner, the greatest dispersion of the pressure can be achieved.

The pillars are also provided with pressure dispersing characteristics by adjusting their wall thickness to provide an even collapse of all of the pillars when the expected load is placed upon the upper surface. That is, when the pillars are in contact with the support surface on which they rest, they exhibit a substantially even pressure resistive force. The collapse of the pillars disperses the load of the body and provides less resistive forces to the tuberosities of a patient (an area generally exhibiting greatest pressure) than to the surrounding tissue.

Figure 7:
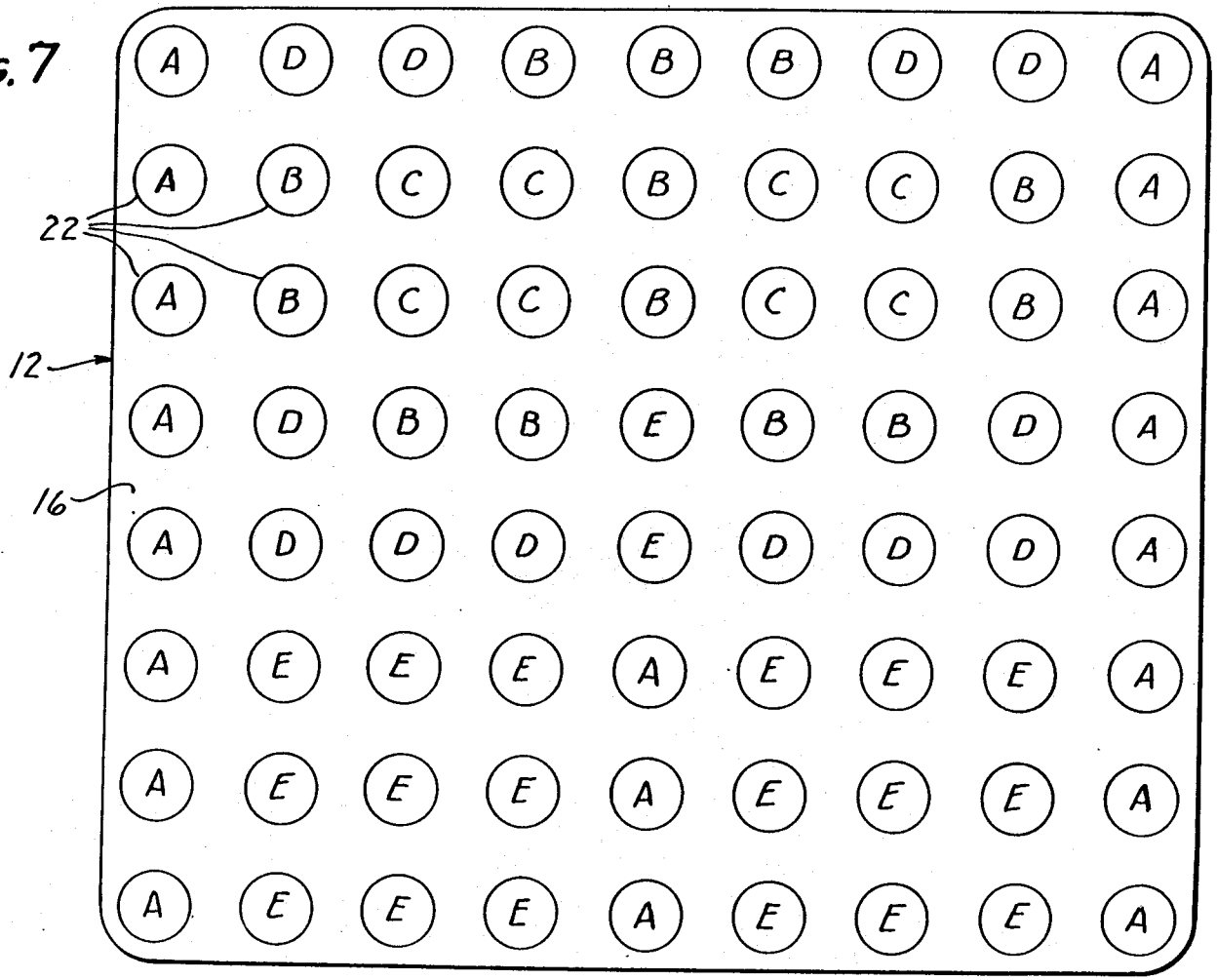
FIG. 7 is a diagramatic view of the pillar placement for the body support pad.

With regard to FIG. 7, the preferred body support pad having the above described physical dimensions with an array of 72 pillars has five types of pillars arrayed over the lower surface. The five types of pillars with differing pressure dispersing characteristics are identified by the letters A, B, C, D, and E.

The array providing the least resistance but greatest pressure dispersing characteristics is the discrete arrays identified by the letter C in FIG. 7. The two arrays identified correspond to the ischiam tuberosities of the patient. The ischiam tuberosities are the two appendages which drop from the front of the hip bone and are generally the most frequent areas of pressure sores. On a patient, they are roughly four inches apart and protrude about 1 and $\frac{3}{4}$ inches down from the main area of the pelvis. The pad herein relieves pressures under the ischiam tuberosities to as low as possible, generally within the pressure range of about 20 to 40 millimeters of mercury (mm Hg). To provide such a pressure relief, the pillars are constructed of an open celled, microcellular urethane and have a height of about 0.75 inches and a wall thickness of about 0.10 inches. The pillars in this discrete array have the shortest height of all the pillars as this area receives the greatest pressure from the patient's body and, therefore, the base member 12 deflects its greatest amount in this area.

The next discrete array of pillars is represented by the letter B in FIG. 7. These pillars exhibit a pressure dispersion slightly greater than the pillars designated as C. The pillars designated B correspond to the coccyx and trochanter regions of a patient's body supported on the body support pad. These two areas exhibit the next greatest pressure and for this reason, it is desirable to prevent pressure buildup at the trochanter and coccyx areas. The pillars designated B exhibit a pressure relief in the pressure range of about 10 to 30 millimeters of mercury. The pillars designated B have a height of about 1 inch and a wall thickness of 0.125 inches.

The next distinct array of pillars exhibiting the next pressure relief value are those designated as D in FIG. 7. These pillars correspond also to the area around the coccyx as well as the area adjacent the trochanter and leading to the posterior thigh region. The pillars designated D have a height of about 1.125 inches and a wall thickness of about 0.150 inches.

The next array of pillars are those designated by the letter E and are located at the front of the pad. The pillars designated E correspond to the thigh region of the patient, whether the posterior or anterior region of the thighs. It is desirable to disperse some of the pressure into the thigh region as the fleshy part of the thighs can disperse the pressure load. The pillars designated as E have a height of about 1.125 inches and a wall thickness of about 1.125 inches.

The array of pillars in FIG. 7 designated with the letter A exhibits the greatest pressure resistance as it provides support for the body support pad. As can be seen in FIG. 7, the arrar of pillars designated as A extend generally along the sides of the pad as well as a small discrete array between the thighs of the patient. The pillars designated as A have a height of about 1¼ inches and a wall thickness of about 0.175 inches. The thigh area is the area that is capable of taking high seating pressures, however, care must be taken to insure proper postural positioning and, therefore, the thigh region contains both the A, E, and D type pillars. The surrounding tissue is ideal for pressure relief as it has a high fatty content and assures a good pressure distribution. For this reason, the greater resistive pillars designated as A are provided for such a surrounding tissue area.

As can be seen by the above discussion with regard to the pillar placement and the various arrays of the pillars, the body support pad is designed to distribute the weight of a person to the thighs and surrounding tissue. The weight is transferred to the thighs and is generally substantially equally distributed between the anterior and posterior regions of the thighs. The pad provides acceptable lateral (side to side and front to back) stability by the arrangement of the pillars in order to aid maintaining a healthy posture and to provide stability to patients such as spinal cord injury patients. The arrays of the pillars with their differing pressure dispersing characteristics are designed to collapse at different pressures and thereby distribute the seating pressures away from the tuberosities and coccyx and toward the thighs and surrounding tissues. An advantage of the design herein is that the body support pad can be adjusted to accommodate the particular conditions of a patient. That is, the individual pillars can be cut to adjust their height and thereby their pressure dispersing characteristics for the individual needs of a patient.

The body support pad herein redistributes the pressure exerted upon it by a patient supported on the pad by a combination of resilient design and body contouring. That is, the individual pods and pillars are selected and their wall thickness adjusted to provide different resiliencies and the pillars are contoured (height adjusted) to accommodate the various portions of the patient's body which exhibit differing pressures. The body support pad herein can be integrally molded in one easy step such as by the use of a reaction injection moldable, flexible, microcellular skinned, urethane foam material. The material is injection molded into the mold and then subsequently undergoes reaction to cure to form the open celled, microcellular, urethane structure. While molding the body support pad, the ventilation apertures can also be simultaneously molded to provide acceptable ventilation to the completed pad.

Figure 9:
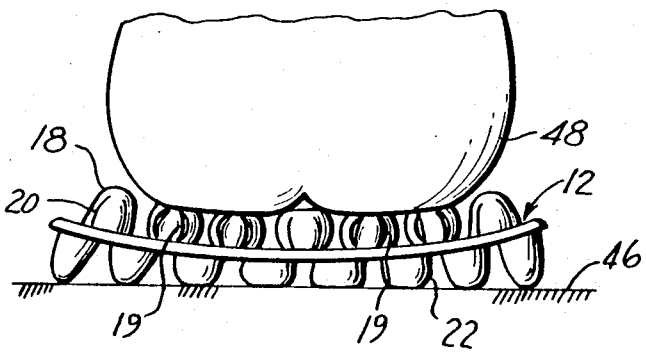
FIG. 9 is a side elevational view of the body support pad illustrating how the body support pad supports a patient.

The use of the body support pad can be better understood with regard to FIG. 9 which is an illustration of the pad in use supporting a patient's body 48. As can be seen from the illustration, the patient's body is supported by the pad and encounters and compresses the pods on the upper surface of the base member of the pad. As the pods are compressed, they provide a greater surface area which encounters the patient's body. That is, the hemispherical shape and the opening slots 19 (the slots expand or open upon pressure collapsing each pod) provide a greater surface area which is in contact with the body. The hemispherical shape also exerts a pressure back on the body at about the same location where the force is exerted by the body on the pod. Thus, there is a pressure exerted by the pod back on the body about normal to the body. The force on the body then is normalized which aids in the inhibition of decubitus ulcers as such forces tend to be dispersed over the surface area that is in contact with the pod.

FIG. 9 also shows the contouring or distortion of the base member 12. As can be seen from such distortion, the pillars come into contact with the support surface 46 upon which the body support pad rests. The shorter pillars in the areas representing the discrete arrays for the coccyx and ischiam tuberosities encounter the support surface, but some of the initial force and pressure caused by the patient's body is initially absorbed in the flexing or distortion of the base member 12, thus spreading the force over the surface of the body support pad. As the pillars tend to collapse or compress under the pressure of the patient's body, there is a generally even distribution as the pillars are all designed to further compress at about the same resistive forces. Initially the resistance is slight, then increases as the pillars collapse and more pillars come into contact and as more pillars start to compress due to the weight of the patient's body.

From the above discussion with regard to a seating pad or a wheelchair pad, it is submitted that one having skill in the art can extend the teachings to the construction and adaptation of a full body support pad such as can be used on a bed.

What is claimed is:

1. A body supporting pad comprising:

a generally flexible base member having an upper surface and a lower suface;

a plurality of pillar means extending outwardly from the lower surface and arranged in discrete arrays of pillar means of substantially similar character for substantially evenly contacting any supportive surface upon which the pad is placed while a body is supported on the pad and for providing different resistive forces in each of such discrete arrays of pillar means; and a plurality of pod means extending outwardly from the upper surface and axially offset from the pillar means, for providing resistive forces to the body generally normal to the body.

2. A body support pad as recited in claim 1 wherein the body support pad comprises an integrally molded planar base member, plurality of pillar means, and plurality of pod means.

3. A body support pad as recited in claim 2 wherein the body support pad comprises an integrally molded microcellular urethane foam.

4. A body support pad as recited in claim 1 further comprising ventilation means of the body support pad for providing ventilation through the pad.

5. A body support pad as recited in claim 4 wherein the ventilation means comprises apertures extending through the flexible base member.

6. A body support pad as recited in claim 4 wherein the ventilation means comprises apertures extending through the pillar means.

7. A body support pad as recited in claim 4 wherein the ventilation means comprises apertures extending through the pod means.

8. A body support pad as recited in claim 4 wherein the ventilation means comprises apertures extending through the pillar means and pod means.

9. A body support pad as recited in claim 1 wherein the plurality of pillar means are arranged in at least two discrete arrays of pillar means of differing pressure dispersing characteristics.

10. A body support pad as recited in claim 9 wherein the pillar means are arranged in five discrete arrays of differing pressure dispersing characteristics.

11. A body support pad as recited in claim 10 wherein a first discrete array of pillar means are provided on the body support pad in an area designed for encountering the ischiam tuberosities and coccyx; a second discrete array of pillar means for encountering the trochanter area; a third discrete array of pillar means for encountering the area adjacent the ischiam tuberosities and coccyx; a fourth array of pillar means for encountering the thigh area; and fifth array of pillar means for providing lateral support.

12. A body support pad as recited in claim 11 wherein the first array comprises pillar means of relatively low pressure dispersing characteristics.

13. A body support pad as recited in claim 12 wherein the second array of pillar means comprises pillar means having pressure dispersing characteristics slightly greater than the pillar means in the first array.

14. A body support pad as recited in claim 13 wherein the third array of pillar means comprises pillar means having pressure dispersing characteristics greater than the pressure dispersing characteristics of the pillar means in the second array.

15. A body support pad as recited in claim 14 wherein the fourth array of pillar means comprises pillar means having pressure dispersing characteristics greater than the pressure dispersing characteristics of the pillar means in the fourth array.

16. A body support pad as recited in claim 15 wherein the fifth array of pillar means comprises pillar means having pressure dispersing characteristics greater than the pressure dispersing characteristics of the pillar means in the fourth array.

17. A body support pad as recited in claim 1 further comprising a foam overlay pad means for increasing the contact surface area between the body supported by the pad and the pad.

18. A body support pad as recited in claim 17 further comprising a cover means for extending over the foam overlay and over the base member and its pillar means and pod means for preventing hammocking and for aiding and maintaining the foam overlay on the base member.

19. A body support pad as recited in claim 17 wherein the foam overlay further comprises ventilating means extending through the foam overlay for providing air flow through the foam overlay.

20. A body support pad as recited in claim 19 wherein the ventilation means comprises a plurality of apertures extending through the foam overlay.

21. A body support pad comprising:

a generally flexible base member having an upper surface and a lower surface;

a plurality of pod means extending outwardly from the upper surface and arranged in discrete arrays wherein each array of pod means provides different resistive forces generally normal to the body supported on the pad, and a plurality of pillar means extending outwardly from the lower surface for substantially evenly contacting any supportive surface upon which the pad is placed while a body is supported on the pad.

22. A body support pad as recited in claim 21 wherein each pod means comprises a generally cylindrical projection having a generally hemispherically shaped upper surface and wherein the pressure dispersing characteristics are provided by the wall thickness of the pod means.

23. A body support pad as recited in claim 22 wherein the pod means further comprises slits along their surface for maintaining a substantial surface area contact with the supported body on the body support pad.

24. A body support pad as recited in claim 21 wherein each pillar means comprises a generally conical shaped structure having a rounded end and wherein the pillar means are provided with differing pressure dispersing characteristics by altering the height and wall thickness of each pillar means.

25. A body support pad as recited in claim 21 wherein the pillar means and pod means are axially offset from one another on the respective upper and lower surfaces of the base member.

26. A body support pad as recited in claim 21 further comprising a foam overlay pad adapted to rest on the plurality of pod means.

27. A body support pad as recited in claim 26 further comprising ventilation means extending thrugh the foam overlay pad for providing air circulation therethrough.

28. A body support pad as recited in claim 27 further comprising a two-way stretchable cover which holds the foam overlay pad onto the body support pad.

* * * * *